US008813526B2

(12) United States Patent
Doyle et al.

(10) Patent No.: US 8,813,526 B2
(45) Date of Patent: Aug. 26, 2014

(54) WATER FLOW PATHS IN A HOUSEHOLD CLEANING APPLIANCE WITH SINGLE USE AND BULK DISPENSING

(75) Inventors: Colleen M. Doyle, Stevensville, MI (US); Joel Adam Luckman, Benton Harbor, MI (US); Michael S. Hendrickson, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1187 days.

(21) Appl. No.: 12/165,780

(22) Filed: Jul. 1, 2008

(65) Prior Publication Data

US 2010/0000581 A1 Jan. 7, 2010

(51) Int. Cl.
*D06F 29/00* (2006.01)

(52) U.S. Cl.
USPC ..... 68/17 R

(58) Field of Classification Search
CPC ..... D06F 39/02; D06F 39/022; D06F 39/028
USPC ..... 134/99.2; 68/17 R
See application file for complete search history.

(56) References Cited

U.S. PATENT DOCUMENTS

| | | | | |
|---|---|---|---|---|
| 2,872,076 | A | 2/1959 | Bloom | |
| 3,120,329 | A | 2/1964 | Noakes | |
| 3,881,328 | A * | 5/1975 | Kleimola et al. | 68/12.18 |
| 3,990,272 | A * | 11/1976 | Gakhar | 68/17 R |
| 4,009,598 | A | 3/1977 | Bernard et al. | |
| 4,103,520 | A | 8/1978 | Jarvis et al. | |
| 4,426,362 | A | 1/1984 | Copeland et al. | |
| 4,569,781 | A * | 2/1986 | Fernholz et al. | 510/225 |
| 4,763,494 | A | 8/1988 | Der Kinderen | |
| 5,186,912 | A | 2/1993 | Steindorf et al. | |
| 5,195,338 | A | 3/1993 | Russo | |
| 5,758,521 | A | 6/1998 | Roberts | |
| 5,839,097 | A | 11/1998 | Klausner | |
| 5,992,685 | A | 11/1999 | Credle, Jr. | |
| 2003/0116177 | A1 | 6/2003 | Appel et al. | |
| 2005/0229652 | A1 * | 10/2005 | Kim et al. | 68/237 |
| 2006/0107705 | A1 | 5/2006 | Hsu et al. | |
| 2009/0100880 | A1 * | 4/2009 | Hill | 68/17 R |

FOREIGN PATENT DOCUMENTS

| | | | |
|---|---|---|---|
| CA | 2027154 | A1 | 4/1991 |
| DE | 8033429 | U1 | 5/1982 |
| DE | 3403622 | A1 | 8/1985 |
| DE | 69019666 | T2 | 10/1995 |
| EP | 0169604 | A2 | 1/1986 |
| EP | 423044 | A1 * | 4/1991 |
| EP | 0611159 | A1 | 8/1994 |
| EP | 0685587 | A1 | 12/1995 |
| EP | 1731654 | | 12/2007 |
| GB | 2015870 | A | 9/1979 |
| GB | 2136831 | A | 9/1984 |
| WO | 0220893 | A1 | 3/2002 |
| WO | 2006094219 | A2 | 9/2006 |
| WO | 2007056097 | A2 | 5/2007 |

OTHER PUBLICATIONS

Machine Translation of Arnaud et al., EP 0 423 044 A1, Apr. 1991.*
German Search Report for Counterpart DE102009030289, Feb. 11, 2014.

* cited by examiner

*Primary Examiner* — David Cormier

(57) ABSTRACT

An apparatus with water flow paths suitable for a household cleaning appliance having both a non-bulk dispensing system and a bulk dispensing system.

10 Claims, 3 Drawing Sheets

WATER FLOW PATHS IN A HOUSEHOLD CLEANING APPLIANCE WITH SINGLE USE AND BULK DISPENSING

BACKGROUND OF THE INVENTION

Contemporary cleaning appliances, such as dishwashers or clothes washers, are a common convenience in many homes. A user simply loads the cleaning appliance with laundry to be treated into a treating chamber, along with an optional supply of a treating chemistry, such as detergents, bleach, enzymes, and anti-spotting agents and selects and initiates a cleaning cycle that may be subsequently automatically carried out by the cleaning appliance. An example of a typical cleaning cycle includes the steps of washing the laundry with heated liquid and optional treating chemistry and rinsing the laundry with heated liquid.

Cleaning appliances may be provided with a dispenser for automatically dispensing one or more treating chemistries during a cleaning cycle. There are generally two types of treating chemistry dispensing systems found in the cleaning appliances: single use dispensing systems and bulk dispensing systems. The single use dispensing system is by far the most common type and typically has one or more dispensing cups that may be filled with only enough treating chemistry, i.e. a "charge" or "dose", for a single cleaning cycle. Water is then flushed through the cup to dispense the treating chemistry. A user must fill these single use dispensing systems with treating chemistry prior to each cleaning cycle of the cleaning appliance, which may be a tedious task that many users would prefer not to perform. Users have also been known to forget to fill the cup, fill the cup with the wrong treating chemistry, or to fill the cup with the wrong amount of treating chemistry.

The bulk dispensing systems, while known, are not very common. The bulk dispensing systems hold multiple charges of treating chemistries. Some systems are capable of controlling and varying the amount of treating chemistry. These systems are more convenient to the user in the sense that the user only has to remember to fill them once over several cycles of operation. However, they are less convenient in that if the user has a non-standard wash load that requires a special treating chemistry, the bulk dispensing system may be loaded with the wrong treating chemistry.

Only a few cleaning appliances have both single use and bulk dispensing systems. The two systems are functionally redundant and add cost to the cleaning appliance. Further, each system tends to have water supply systems that are incompatible because of the different manner in which the systems dispense the treating chemistry.

SUMMARY OF THE INVENTION

The invention relates to a household cleaning appliance with water flow paths for both a non-bulk dispensing system and a bulk dispensing system.

DESCRIPTION OF EMBODIMENTS OF THE INVENTION

Figure 1:
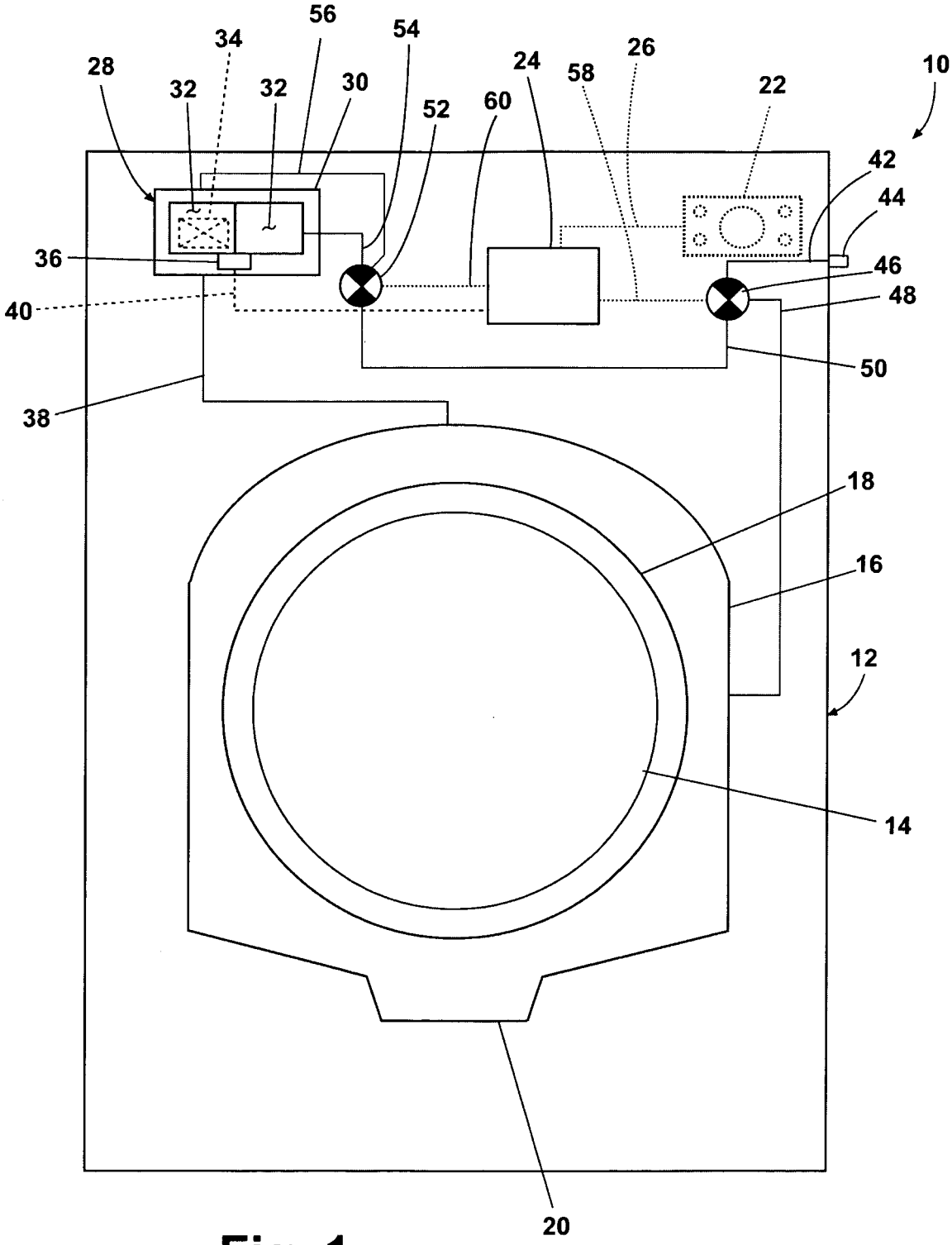
FIG. 1 is a schematic view of an automatic clothes washing machine according to the invention.

Referring now to FIG. 1, a first embodiment of the invention may be illustrated as a cleaning appliance in the environment of a horizontal axis automatic clothes washing machine 10. Although much of the remainder of this application will focus on the embodiment of an automatic clothes washing machine, the invention may have utility in other environments, including other cleaning appliances, such as dishwashers, for example. The automatic clothes washing machine 10 shares many features of a conventional automated clothes washer, which will not be described in detail herein except as necessary for a complete understanding of the invention. The invention may also be utilized in fabric treatment appliances such as a dryer, such as a tumble dryer or a stationary dryer, or a combination washing machine and dryer.

Further, washing machines are typically categorized as either a vertical axis washing machine or a horizontal axis washing machine. As used herein, the "vertical axis" washing machine refers to a washing machine having a rotatable drum that rotates about a generally vertical axis relative to a surface that supports the washing machine. However, the rotational axis need not be vertical. The drum can rotate about an axis inclined relative to the vertical axis. As used herein, the "horizontal axis" washing machine refers to a washing machine having a rotatable drum that rotates about a generally horizontal axis relative to a surface that supports the washing machine. In some horizontal axis washing machines, the drum rotates about a horizontal axis generally parallel to a surface that supports the washing machine. However, the rotational axis need not be horizontal. The drum can rotate about an axis inclined relative to the horizontal axis, with fifteen degrees of inclination being one example of inclination.

Vertical axis and horizontal axis machines are often best differentiated by the manner in which they impart mechanical energy to the fabric articles. In vertical axis machines, the fabric moving element moves within a drum to impart mechanical energy directly to the clothes or indirectly through wash liquid in the drum. In horizontal axis machines mechanical energy is typically imparted to the clothes by the tumbling action formed by the repeated lifting and dropping of the clothes, which is typically implemented by the rotating drum itself. The invention disclosed herein may be suitable for use in both horizontal axis and vertical axis automatic clothes washing machines. The invention will be illustrated and described, however, in the context of a horizontal axis washing machine.

The automatic clothes washing machine 10 may include a cabinet 12 defining an interior and enclosing components typically found in a conventional washing machine, such as motors, pumps, fluid lines, controls, sensors, transducers, and the like. A door 14 may be mounted to the cabinet to selectively close an access opening to the interior of a drum 16 that defines a treating chamber in which an article may be treated. Examples of articles include, but are not limited to, a hat, a scarf, a glove, a sweater, a blouse, a shirt, a pair of shorts, a dress, a sock, a pair of pants, a shoe, an undergarment, and a jacket. One or more articles form a laundry load. Both the drum 16 and a basket 18 may be located within the interior of the cabinet 12. The drum 16 may be associated with a sump 20 for holding a liquid used during a cleaning cycle. The sump 20 may be normally connected to a drain (not shown) to provide a flow path for removing the liquids from the washing machine 10.

While the drum 16 may be described as defining the treating chamber, with the basket 18 located within the drum, and thereby located within the treating chamber, it may be that just the basket need be considered the treating chamber as the laundry load is typically retained within the basket and the treating chemistry may be dispensed directly into the basket or indirectly through the drum.

While not shown, some clothes washers include a recirculation system for recirculation of liquid from the sump to the laundry in the basket 18. The recirculating spray may be used in combination with rotating the drum to draw the sprayed liquid through the laundry using centrifugal force. Alternatively, or in combination with the recirculation system, the liquid may be raised to a level within the drum 16 where a portion of the basket 18 may be submerged. The rotation of the basket 18 causes the laundry to tumble in the liquid. Either of the recirculation or tumble methods of cleaning may be used with the current invention.

A user interface 22 may be provided that has operational controls such as dials, lights, switches, and displays enabling a user to input commands to a controller 24 and receive information about a specific cleaning cycle from sensors (not shown) in the washing machine 10 or via input by a user through the user interface 22. To aid the input of information by the user, the user interface 22 may be electrically coupled with the controller 24 through user interface leads 26. The user may enter many different types of information, including, without limitation, cycle selection and cycle parameters, such as cycle options. Any suitable cycle may be used. Examples include, Heavy Duty, Normal, Delicates, Rinse and Spin, Sanitize, and Bio-Film Clean Out, to name a few. The term "cleaning cycle" is used to mean one operational cycle of the automatic clothes washing machine 10 that cleans a load of laundry.

The cabinet 12 may also include a dispensing system 28 for dispensing treating chemistry during a cleaning cycle. In this embodiment the treating chemistry may be any type of aid for treating laundry, and examples may include, but are not limited to washing aids, such as detergents and oxidizers, including bleaches, and additives, such as fabric softeners, sanitizers, de-wrinklers, and chemicals for imparting desired properties to the laundry, including stain resistance, fragrance (e.g., perfumes), insect repellency, and UV protection.

The dispensing system 28 may include a dispenser housing 30 fluidly coupled to the drum 16. FIG. 1 illustrates the dispenser housing 30 as being located in the upper portion of the cabinet 12 such that a user may access it from the exterior of the cabinet 12, although other locations are also possible. The dispensing system 28 may further include a single use dispensing system fluidly coupled to the dispenser housing 30. The single use dispensing system is illustrated as having at least one dispensing cup 32 that stores a single dose of treating chemistry that the dispensing system 28 dispenses to the drum 16, as part of the execution of the cleaning cycle. The at least one dispensing cup 32 may be located within the dispenser housing 30 and may fluidly couple the dispenser housing 30 such that when the at least one dispensing cup 32 overflows, the overflow goes to the dispenser housing 30. Further, the single use dispensing system may be illustrated as including multiple dispensing cups 32.

The dispensing system 28 may also include a bulk dispensing system fluidly coupled to the dispenser housing 30 for dispensing a charge of treating chemistry to the dispenser housing 30. For example, in the embodiment shown, the bulk dispensing system may be fluidly coupled to the dispenser housing 30 and may directly supply the treating chemistry it dispenses to the dispenser housing 30. The bulk dispensing system is illustrated as a bulk dispensing cartridge 34 that may be received in the at least one dispensing cup 32 and may fluidly couple with the dispenser housing 30 such that the bulk dispensing cartridge 34 may directly supply the treating chemistry to the dispenser housing 30.

Although the bulk dispenser cartridge has been illustrated or described as a rectangular box-like container, the bulk dispensing cartridge may be any type of removable container configured to store multiple doses of a treating chemistry. The container may have any shape and size that is receivable within the dispenser. The removable container may be flexible, rigid, expandable, or collapsible. The container may be made of any type of material. Some examples of suitable cartridges are, without limitation, a plastic container, a cardboard container, a coated cardboard container, and a bladder, all of which are capable of being received within the dispenser.

The bulk dispensing system may include a treating chemistry meter 36 operably coupled to the bulk dispensing cartridge 34 to control the dosing of the treating chemistry from the bulk dispensing cartridge 34. The treating chemistry meter 36 may be integrated with the bulk dispensing cartridge 34 or separate, and it may dispense into one of the cups 32, or the dispenser housing 30. The treating chemistry meter 36 may be a mechanical flow meter, a magnetic flow meter, or any other meter suitable for measuring liquid flow, all well known in the cleaning appliance art. As illustrated, the treating chemistry meter 36 dispenses into the dispenser housing 30, which in turn fluidly couples the drum 16 through a dispensing line 38.

Although the dispensing system 28 thus far has been described as including a dispenser housing 30 the dispenser housing 30 could be eliminated and replaced with a conduit. In that case, the at least one dispensing cup 32 of the single use dispensing system may be located such that when the at least one dispensing cup 32 overflows, the overflow goes to the dispensing line 38 or a similar conduit (not shown) that leads to the drum 16. Further, if the dispenser housing 30 is eliminated the bulk dispensing cartridge 34 may directly supply the treating chemistry to the treating chamber or a conduit, such as the dispensing line 38, which leads to the treating chamber.

The treating chemistry meter 36 may also be a pump fluidly coupling the bulk dispensing cartridge 34 to the dispenser housing 30. The treating chemistry meter 36 may be operably coupled with the controller 24, through a control lead 40, such that the controller 24 may implement the cleaning cycle by controlling the operation of the treating chemistry meter 36 to control the dosing of the treating chemistry from the bulk dispensing cartridge 34 to the dispenser housing 30.

A water supply system typically provides water to the single use and bulk dispensing systems. The water supply system is illustrated as having a conduit 42 fluidly coupled with a water supply 44, and a valve 46. The water supply 44 may be fluidly coupled directly to the drum 16 through conduit 42 to valve 46 and then through a dispensing line 48. The water supply 44 may also be coupled to the drum 16 via the dispensing system 28, where water is supplied to the dispensing system 28 through conduit 42, valve 46, and conduit 50, to a diverter valve 52, which controls the flow of water to either the dispensing cups 32 through conduit 54 or to the dispenser housing 30 through conduit 56. The conduits 54 and 56 define alternative flow paths to the dispensing system 28, with the flow path associated with conduit 54 supplying the cups 32 for the single use dispensing system and the flow path associated with conduit 56 supplying the bulk dispensing system.

In the embodiment shown, regardless of which flow path is used, the fluid exits the dispensing system 28 through dispensing line 38 to the drum 16.

With this configuration, the water supply system may control the flow of water directly or indirectly to the drum, to the single use dispensing system, and to the bulk dispensing system. Thus, the valve 46 may introduce fresh water from the water supply 44 into the drum 16, or the dispensing system 28. The valve 46 may be electrically coupled with the controller 24 through a valve control lead 58. The controller 24 may control the operation of the valve 46 in response to instructions received from the user interface 22 as a result of selections made by the user, such as cleaning cycle, water temperature, spin speed, extra rinse, and the like. Alternatively, the user may override the automatic dispensing function for a single cleaning cycle. In this method, the selection of either the single use dispensing system or the bulk dispensing system may be inputted by the user through a separate button (not shown) on the user interface 22. In that case, the manual button may control the operation of the valve 46 in response to what system was selected by the user.

Looking at the flow paths in greater detail, the first water flow path along conduit 54 may flush the charge of treating chemistry from the cup 32 of the single use dispensing system into the dispenser housing 30 and then into the drum 16. The second water flow path 56 may flush the charge of treating chemistry, dispensed from the bulk dispensing cartridge 34 into the dispenser housing 30, from the dispenser housing 30 into the drum 16. The first water flow path 54, as illustrated in FIG. 1, supplies water to the dispenser housing 30 through the at least one dispensing cup 32. While the second water flow path 56, as illustrated, supplies water directly to the dispenser housing 30 and bypasses the at least one dispensing cup 32.

FIG. 1 illustrates that the first water flow path 54 and the second water flow path 56 may be independent prior to reaching the dispenser housing 30. Alternatively, the first water flow path 54 and the second water flow path 56 may become independent at some point within the dispenser housing 30. In FIG. 1, the diverter valve 52 marks the divergence of the first water flow path 54 and the second water flow path 56. The diverter valve 52 may be electrically coupled with the controller 24 through a valve control lead 60. The controller 24 may control the operation of the diverter valve 52 in response to instructions received from the user interface 22 as a result of selections made by the user, such as when manual dispensing may be desired water may be directed down the first water flow path 54 and when bulk dispensing may be desired water may be directed down the second water flow path 56.

The dispensing line 38 fluidly couples the dispenser housing 30, and both the single use dispensing system and bulk dispensing system, with the drum 16. Thus, fresh water may be delivered from the water supply 44 into the dispensing system 28 for flushing treating chemistry from the dispensing system 28 through the dispensing line 38 into the drum 16.

In operation, a user may elect to dispense treating chemistry to the drum 16, directly from the at least one dispensing cup 32 by manually supplying a single dose of treating chemistry to the at least one dispensing cup 32 from an external supply of treating chemistry. The user may select a manual dispense cleaning cycle on the user interface 22, which would then be processed by the controller 24.

When operating in manual dispensing mode during operation of the automatic clothes washing machine 10, when the time comes to dispense the treating chemistry, the controller 24 signals the valve 46 and the diverter valve 52 to supply water to the first water flow path 54. Water from the first water flow path 54 enters into the at least one dispensing cup 32 wherein the water may be directed towards the treating chemistry located in the at least one dispensing cup 32. The water and the treating chemistry then overflow the at least one dispensing cup 32, typically through a siphon post in the cup that drains into the housing, and enter the dispenser housing 30. Alternately, other dispensing techniques known to those skilled in the art could also be used. Essentially, the automatic clothes washing machine 10 effects a flushing of the at least one dispensing cup 32, the dispenser housing 30, and the conduit formed by the dispenser housing 30 and the dispensing line 38. As such, both the water and the treating chemistry travel from the at least one dispensing cup 32 and into the drum 16. After exiting the dispenser housing 30 the treating chemistry may also go through any accompanying mixing devices, pumps, sprayers or conduits on its way to the drum 16.

Alternatively, the user may insert or may have already inserted the bulk dispensing cartridge 34 into another at least one dispensing cup 32 and elect to dispense treating chemistry to the drum 16, from the bulk dispensing cartridge 34. A selected volume of treating chemistry may be dispensed from the bulk dispensing cartridge 34 through operation of the treating chemistry meter 36 under the control of the controller 24. Typically, this could be accomplished by the user selecting a cleaning cycle on the user interface 22, which would then be processed by the controller 24, along with an optional determination in a known manner of the size of the load or other load parameters, to automatically dispense the appropriate volume of treating chemistry.

When operating in bulk dispensing mode during operation of the automatic clothes washing machine 10, when the time comes to dispense the treating chemistry, the controller 24 signals the treating chemistry meter 36 to supply treating chemistry from the bulk dispensing cartridge 34 to the dispenser housing 30. The controller 24 then signals the valve 46 and the diverter valve 52 to supply water to the second water flow path 56 wherein the water may be directed towards the treating chemistry located in the dispenser housing 30. Essentially, the automatic clothes washing machine 10 effects a flushing of the dispenser housing 30 and the dispensing line 38. The flushing of the dispenser housing 30 may also act to flush the treating chemistry meter 36, which fluidly couples the dispenser housing 30. Then, both the water and the treating chemistry travel through the dispenser housing 30 and through the dispensing line 38, and into the drum 16.

Further, both the single use dispensing system and the bulk dispensing system and the water from the first and second water flow paths could discharge into a pump (not shown). The pump may be operably coupled to the controller 15 such that the controller 15 may control the dispensing of the treating chemistry and water by the actuation of the pump to the treating chamber. Thus, the pump may deliver the treating chemistry and water mixture to the treating chamber under pressure.

The treating chemistry meter 36 may dose treating chemistry into the drum 16 multiple times during a single cleaning cycle. Dosing of the treating chemistry does not need to be done all at one time. For example, smaller amounts of treating chemistry, equal to a full single dose, or in other embodiments, a fraction of a full dose, may be dispensed by the treating chemistry meter 36 at separate times throughout the cleaning cycle. Further, multiple full doses may be dispensed during the cleaning cycle. As used herein, the term "single dose of treating chemistry", and variations thereof, refers to an amount of treating chemistry sufficient for one cleaning cycle of the automatic clothes washing machine 10 and the term "multiple doses of treating chemistry", and variations thereof, refers to an amount of treating chemistry sufficient for multiple cleaning cycles of the automatic clothes washing machine.

The determination of whether the single use dispensing system is used or the bulk dispensing system is used is described as being based on the cycle selected by the user, the determination may be made in many ways and is not germane to the invention. Alternately a manual/bulk mode of operation may be a discrete selection by the user. In other embodiments, the determination may be made by the controller 24 having one or more suitable sensors for detecting the type and quantity of treating chemistry in one or both of the single use or bulk dispensing system and applying control logic to this information to select which dispensing system to use. The controller 24 may also dispense from both dispensing systems during a single cycle. For example, it is contemplated that the bulk dispensing cartridge will hold detergent, as it is the most common treating chemistry, and the cups of the single use dispensing system will hold bleach and/or fabric softener, which are often optional for many of the cycles. In such a situation, the controller 24 would dispense detergent from the bulk dispensing system at the appropriate time in the cycle and, if there is treating chemistry in one or more of the cups, the controller 24 would dispense that treating chemistry using the single use dispensing system at the appropriate time in the cycle.

The two flow paths may provide for a simplified water system that reduces the redundancy in the water supply system. It also provides a simple mechanism by which the controller 24 can effect the dispensing from either the single use dispensing system or the bulk dispensing system. The controller 24 need only select the flow path to the desired system to effect dispensing. The two flow paths also work hand-in-hand with the bulk dispensing cartridge to provide a dispensing system that has an integrated single use dispensing system and a bulk dispensing, which are independently supplied water.

Alternatively, the housing may be absent from the dispensing system 28 and chemistry may be dispensed into the dispensing line 38 both when manual dispensing is desired and when bulk dispensing is desired. When manual dispensing is desired one of the cups 32, which directly fluidly couples the dispensing line 38, may be filled with treating chemistry. Water may then be directed into the cup 32, the water and treating chemistry may mix and be flushed into the dispensing line 38.

When bulk dispensing is desired the treating chemistry meter 36 may dispense treating chemistry directly from the bulk dispensing cartridge 34 to the dispensing line 38. Water may then be introduced from the water supply 44 into the dispensing line 38 where the water and dispensed treating chemistry may form a mixture before being flushed into the drum 16.

Figure 2:
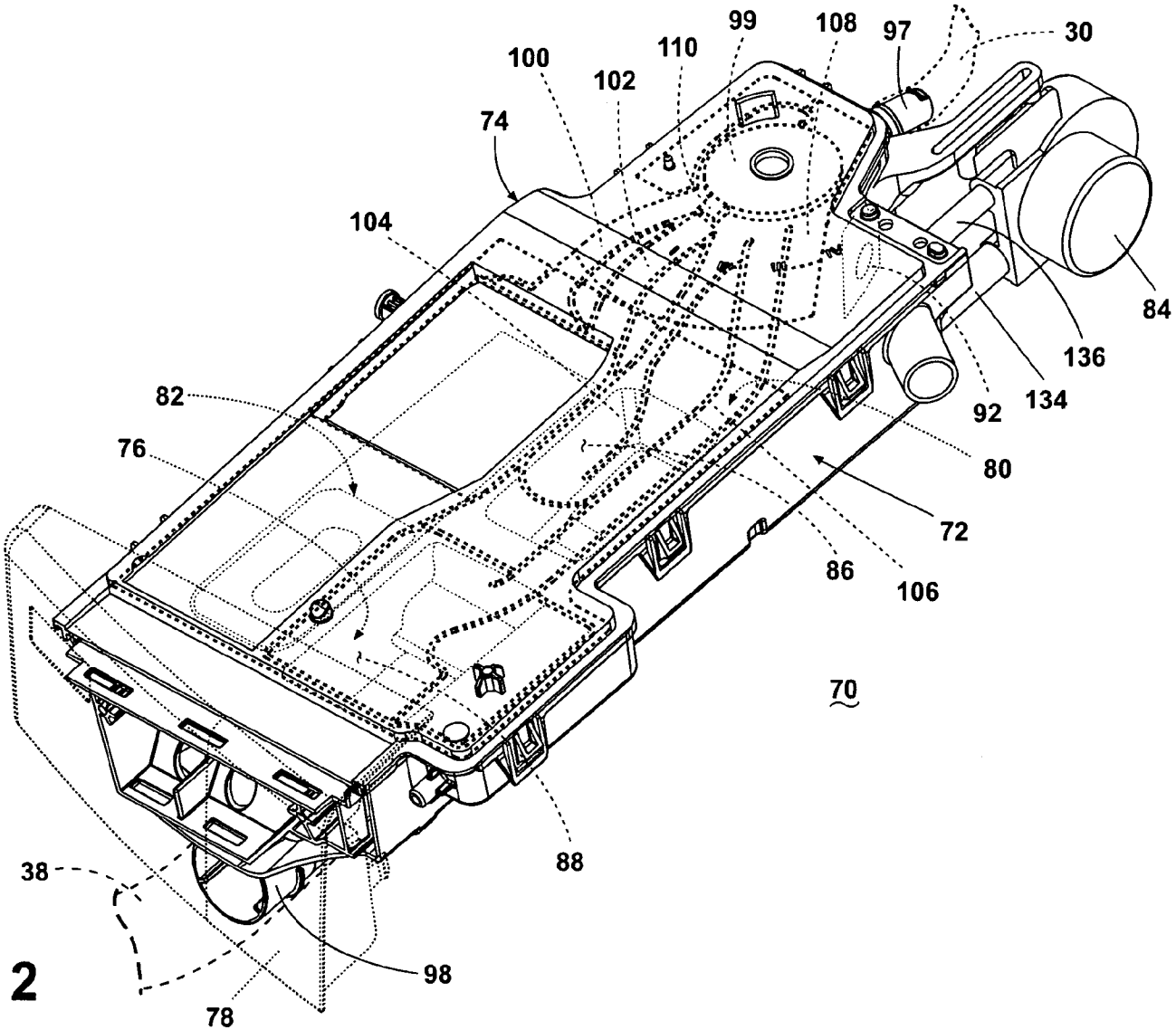
FIG. 2 is a perspective view of an exemplary dispensing system with a bulk cartridge fully received within a dispensing cup.

FIG. 2 illustrates a specific implementation according to one embodiment of the invention of a dispensing system 70 that may be installed in place of the dispensing system 28 in the cabinet 12. The dispensing system 70 includes a lower dispenser housing 72, an upper dispenser housing 74 (shown in phantom), a dispenser drawer 76, a dispenser drawer handle 78, a cup cover 80, a bulk dispensing cartridge 82 configured to store multiple doses of a treating chemistry, and a dispenser pump 84. The dispensing system 70 provides for both a single use dispensing system that may receive the bulk dispensing cartridge 82 to convert at least a portion of the single use dispensing system into a bulk dispensing system. While only the aspects of the dispensing system 70 relevant to the invention will be described, a complete description of the dispensing system 70 is found in the related U.S. application Ser. No. 12/165,712, filed Jul. 1, 2008, entitled A Household Cleaning Appliance with a Dispensing System Operable Between a Single Use Dispensing System and a Bulk Dispensing System and having docket number US20080054, whose description is incorporated by reference.

In general, the bulk dispensing system may be a drawer-type, single-use dispensing system having multiple dispenser cups with bulk dispensing functionality added to the single-use dispensing system by the addition of a bulk dispensing cartridge and a metering device. In other embodiments the bulk dispensing system may be fixed within the cabinet 12 (not shown) and have a moveable door, hatch, access panel, or other access mechanism for access to it.

The lower dispenser housing 72 may be located within the cabinet 12. The lower dispenser housing 72 may fluidly couple to the drum 16 through dispensing line 38. The dispenser drawer 76 may be slideably mounted to the cabinet 12 for movement between a closed position where the dispenser drawer 76 overlies the lower dispenser housing 72 and an opened position exterior of the cabinet 12.

Figure 3:
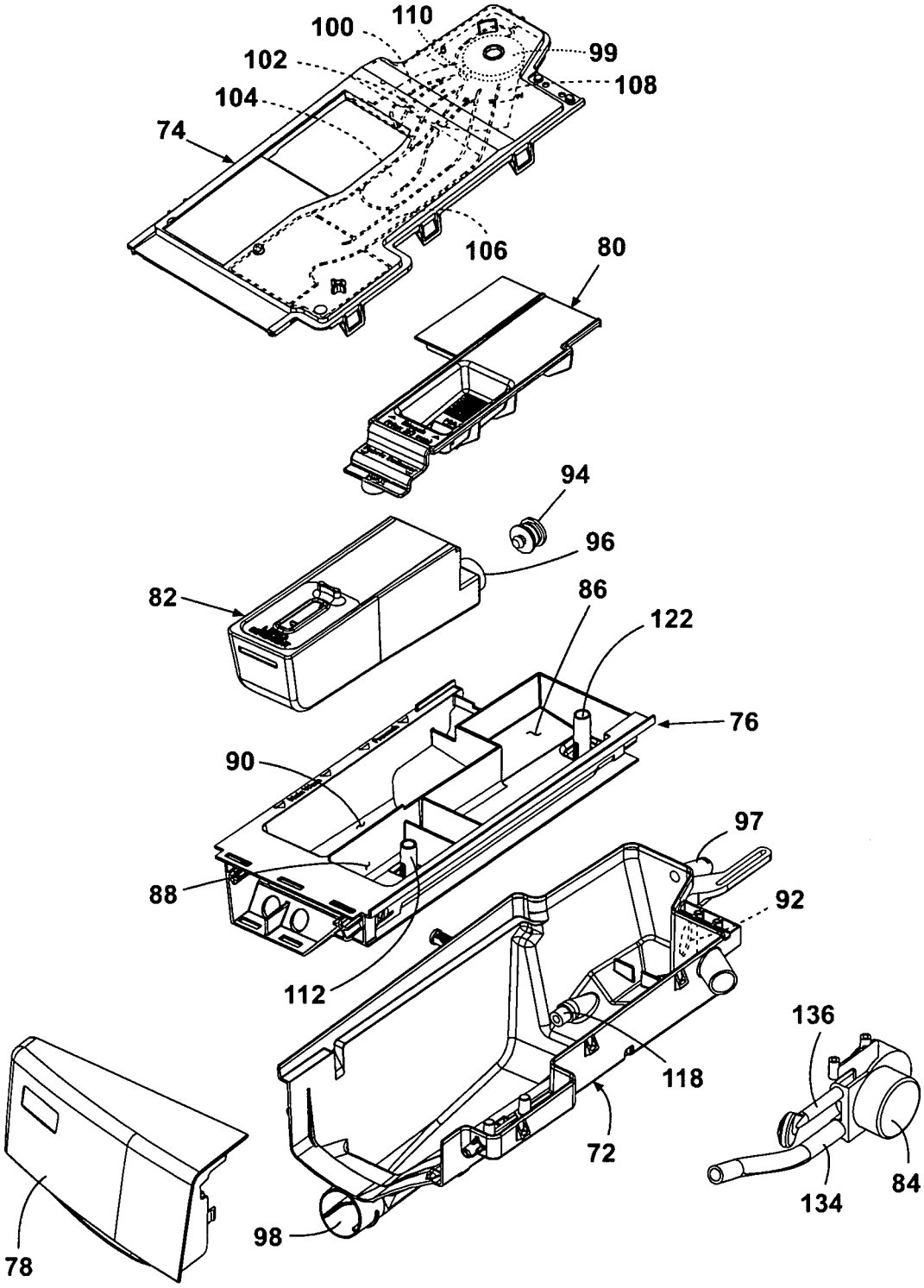
FIG. 3 is an exploded view of the bulk dispensing system illustrated in FIG. 2.

The dispenser drawer 76 may define at least one dispensing cup (depicted as 86, 88) forming a single use dispensing system, fluidly coupled to the treating chamber and used as a treating chemistry compartment to store a single dose of liquid treating chemistry to be dispensed by the dispensing system as part of the execution of a cleaning cycle of the automatic clothes washing machine 10. When the dispenser drawer 76 is in an opened position the at least one dispensing cup 86, 88 may be accessible exteriorly of the cabinet 12 and may be filled or refilled with treating chemistry. The dispenser drawer 76, and thus the at least one dispensing cup 86, 88, fluidly couples to the lower dispenser housing 72 such that when the dispenser drawer 76 overflows the overflow goes to the lower dispenser housing 72. FIG. 3 shows that the at least one dispensing cup 86, 88 may include a dispenser siphon pipe 122, 112, respectively to dispense the treating chemistry placed in the at least one dispensing cup, water may be added to the at least one dispensing cup until the liquid is above the siphon pipe, at which point the liquid may be drawn by gravity into the pipe, which initiates a siphon process for removing the liquid from the at least one dispensing cup. The dispenser drawer handle 78 may be used to effect the movement of the dispenser drawer 76. The cup cover 80 when inserted into the dispenser drawer 76 overlies a portion of the dispenser drawer 76 and more specifically overlies at least a portion of dispensing cups 86, 88.

The bulk dispensing system may be carried by the dispenser drawer 76 and may fluidly couple the lower dispenser housing 72. The bulk dispensing system is illustrated as a bulk dispensing cartridge 82 that may be received in another of the at least one dispensing cup 90 and may fluidly couple the lower dispenser housing 72 such that the bulk dispensing cartridge 82 may supply the treating chemistry to the lower dispenser housing 72. The bulk dispensing cartridge 82 may be configured to store multiple doses of a treating chemistry and thus the use of the bulk dispensing cartridge 82 may eliminate the need for a user to measure out a selected volume of treating chemistry for each cleaning cycle.

It should be noted that while the bulk dispensing cartridge 82 may be configured to fit in any of the dispensing cups 86, 88, and 90, the bulk dispensing cartridge 82 may be sized to fit in the largest of the chambers to maximize the holding capacity of the bulk dispensing cartridge. In most single use dispensing systems, the detergent chamber will be the largest chamber because most detergent chambers are sized to receive both liquid and powder detergents, with powder detergents requiring a larger volume for the same dosing. Typically, a moveable/removable dividing wall may be placed in the detergent chamber and may be moved/removed within/from the chamber to select from liquid or powder detergents. This wall may be removed to make the entire volume of the chamber usable by the bulk dispensing cartridge 82.

Referring back to FIG. 2, the lower dispenser housing 72 may carry the treating chemistry meter, depicted in FIG. 2 as dispenser pump 84, such that when the dispenser drawer 76 may be in the closed position the bulk dispensing cartridge 82 fluidly couples the lower dispenser housing 72 through the dispenser pump 84 and through a lower dispenser housing second port 92 (shown in phantom). A coupler 94 (FIG. 3) fits within a bulk dispensing cartridge port 96 (FIG. 3) and when the dispenser drawer 76 lies in the closed position the bulk dispensing cartridge 82 is fluidly coupled to the dispenser pump 84. Thus, when the dispenser drawer 76 is in the closed position the dispenser pump 84 may draw treating chemistry from the bulk dispensing cartridge 82 and dispense it to the lower dispenser housing 72, which in turn fluidly couples to the drum 16, through dispensing line 38.

The upper dispenser housing 74 may be located within the cabinet 12 and overlying the dispenser drawer 76 when the dispenser drawer 76 sits in a closed position. In this embodiment, the water supply 44 may be fluidly coupled to either of the dispenser drawer 76 or the lower dispenser housing 72 via the upper dispenser housing 74, a water diverter 99, the conduit 50, and the valve 46 that may be operably controlled by the controller 24. The water diverter 99 performs the diverting function of the diverter valve 52 of the first embodiment. Water from the water supply 44 may be fluidly coupled through conduit 50, without any need for the diverter valve 52, with a port 97. Port 97 of the lower dispenser housing 72 illustrates the primary water inlet to the dispensing system from the water supply 44. Once water enters port 97 it may be directed downwards towards the treating chemistry located in the lower dispenser housing 72, wherein both the water and the treating chemistry then travel through the outlet port 98 in the lower dispenser housing 72 through the dispensing line 38 and into the drum 16.

The upper dispenser housing 74 may be formed such that waters flow paths 100, 102, 104, 106, 108 may be located in its interior. Water from the port 97 may enter the water diverter 99 and may be directed through the water diverter outlet 110 into one of the different waters flow paths 100, 102, 104, 106, 108 to either of the lower dispenser housing 72 and to various portions of the dispenser drawer 76. The water diverter 99, and thus the water diverter outlet 110, may be operably coupled with the controller 24. Thus, the water diverter 99, operated by the controller 24, operates to selectively control the fluid coupling of the water diverter outlet 110 with each of the different waters flow paths 100, 102, 104, 106, 108.

For example, a user may elect to dispense treating chemistry to the drum 16, directly from dispensing cup 88 by manually supplying a single dose of treating chemistry to the dispensing cup 88 from an external supply of treating chemistry. Typically, a user may select a manual dispense cleaning cycle on the user interface 22, which would then be processed by the controller 24. During operation of the automatic clothes washing machine 10, when the time comes to dispense the treating chemistry, the controller 24 signals the water diverter 99 to supply water to a first water flow path 106. The controller 24 operates to control the fluid coupling of the water diverter outlet 110 to the first water flow path 106. Water from the first water flow path 106 enters into the at least one dispensing cup 88 wherein the water may be directed towards the treating chemistry located in the dispensing cup 88. Water may be added to the at least one dispensing cup 88 until the liquid is above a dispenser siphon pipe 112, at which point the liquid may be drawn by gravity into the dispenser siphon pipe 112, which initiates a siphon process for removing the liquid from the at least one dispensing cup 88. Thus, the water and the treating chemistry overflow the dispensing cup 88 and enter the lower dispenser housing 72. Essentially, the automatic clothes washing machine 10 effects a flushing of the dispensing cup 88. The addition of water to the dispensing cup 88 may also act to flush the lower dispenser housing 72, and the conduit formed by the lower dispenser housing 72 and the dispensing line 38. Thus, the first water flow path 106 may supply water to the lower dispenser housing 72 through the dispensing cup 88 to flush treating chemistry from the dispensing cup 88 to the lower dispenser housing 72. From the lower dispenser housing 72 both the water and the treating chemistry travel via known ways, e.g., gravity or a pump, from the dispensing cup 88 and into the drum 16.

Alternatively, when the bulk dispensing cartridge 82 is installed in the dispenser drawer 76, a user may elect to dispense treating chemistry to the drum 16 from the bulk dispensing cartridge 82. A user or machine selected volume of treating chemistry may be dispensed from the bulk dispensing cartridge 82 to the lower dispenser housing 72 through operation of the dispenser pump 84 under the control of the controller 24. Typically, this could be accomplished by a user selecting a cleaning cycle on the user interface 22, which would then be processed by the controller 24, along with an optional determination in a known manner of the size of the load and possibly other load characteristics, to automatically dispense the appropriate volume of treating chemistry. Alternatively, the user selecting a volume of treating chemistry on the user interface 22 would accomplish this.

FIG. 3 illustrates an exploded view of the dispensing system 70 of FIG. 2. It may be more clearly seen that the lower dispenser housing 72 may have an outlet port 98. The outlet port 98 fluidly couples the dispensing line 38 with the drum 16. It may more easily be seen in FIG. 3 that a dispenser pump inlet 134 fluidly couples with the bulk dispensing cartridge 82 through a port 118 in the lower dispenser housing 72. Further, a dispenser pump outlet 136 fluidly couples through a lower dispenser housing second port 92 to the lower dispenser housing 72 such that when treating chemistry may be metered through the dispenser pump 84 it may be deposited within the lower dispenser housing 72. The treating chemistry meter may also be a pump that may be internal to the bulk dispensing cartridge 82 and that may meter the flow of treating chemistry directly to the lower dispenser housing 72. From the lower dispenser housing 72 any treating chemistry and water dispensed to the lower dispenser housing 72 may flow to the dispensing line 36 through the outlet port 98.

During operation of the automatic clothes washing machine 10, when the time comes to dispense the treating chemistry, the controller 24 signals the dispenser pump 84 to supply treating chemistry from the bulk dispensing cartridge 82 to the lower dispenser housing 72, the dispensing of the treating chemistry to the lower dispenser housing 72 bypasses the dispenser drawer 76. The controller 24 then signals the water diverter 99 to divert a flow of water through a second water flow path 108 to the lower dispenser housing 72. The controller 24 operates to control the fluid coupling of the water diverter outlet 110 to the second water flow path 108. The second water flow path 108 establishes a water supply to the lower dispenser housing 72 that bypasses the dispenser drawer 76. Thus, the water diverter 99 may selectively fluidly couple the water supply 44 to either the first water flow path 106, or the second water flow path 108. When water may be supplied to the lower dispenser housing 72, it may flow over the treating chemistry previously dispensed into the lower dispenser housing 72. Thus, the second water flow path 108 flushes the charge of treating chemistry from the lower dispenser housing 72 into the drum 16.

In operation, a user may also elect to dispense treating chemistry to the drum 16, directly from the dispensing cup 86 by manually supplying a single dose of treating chemistry to the dispensing cup 86 from an external supply of treating chemistry. When manual dispensing may be desired for the dispensing cup 86 water may be directed down the fifth water flow path 104. The water diverter 99 may divert water through a fifth water flow path 104 to the dispensing cup 86 regardless of the presence of the bulk dispensing cartridge 82. Water may be added to the at least one dispensing cup 86 until the liquid is above a dispenser siphon pipe 122, at which point the liquid may be drawn by gravity into the dispenser siphon pipe 122, which initiates a siphon process for removing the liquid from the at least one dispensing cup 86. Thus, the water and the treating chemistry overflow the dispensing cup 86 and enter the lower dispenser housing 72. The addition of water to the dispensing cup 86 may also act to flush the lower dispenser housing 72, and the conduit formed by the lower dispenser housing 72 and the dispensing line 38. Thus, the fifth water flow path 104 may supply water to the lower dispenser housing 72 through the dispensing cup 86 to flush treating chemistry from the dispensing cup 86 to the lower dispenser housing 72.

Furthermore, a user may elect to dispense treating chemistry to the drum 16, directly from the another dispensing cup 90 by manually supplying a single dose of treating chemistry to the another dispensing cup 90 from an external supply of treating chemistry. The water diverter 99, operated by the controller 24, may divert a flow of water through either a third water flow path 100 or a fourth water flow path 102, to the dispensing cup 90 in the absence of the bulk dispensing cartridge 82.

When manual dispensing may be desired for the another dispensing cup 90 water may be directed down either the third water flow path 100 or the fourth water flow path 102. As the dispensing cup 90 may have been illustrated without a siphon, the treating chemistry and water simply overflow the dispensing cup 90. Water may be added to the dispensing cup 90 until it may be reasonably certain that substantially all of the treating chemistry may be dispensed from the dispensing cup 90. Essentially, the automatic clothes washing machine 10 effects a flushing of the another dispensing cup 90 and this may also act to flush the lower dispenser housing 72. Thus, either the third water flow path 100 or the fourth water flow path 102 may supply water to the lower dispenser housing 72 through the another dispensing cup 90 to flush treating chemistry from the dispensing cup 90 to the lower dispenser housing 72.

As the bulk dispensing cartridge may be received within the dispensing cup 90, a safety device such as a flapper (not shown) that flips up may be installed in the third water flow path 100 or the fourth water flow path 102 to ensure water follows through its desired path of the second water flow path 108 and to prevent water from flowing in the water flow paths 100-102 that may be normally used for manual dispensing.

During operation of the automatic clothes washing machine 10, when bulk dispensing may be desired, when the time comes to dispense the treating chemistry, the controller 24 signals the dispenser pump 84 to supply a treating chemistry from the bulk dispensing cartridge 82 to the lower dispenser housing 72. The controller 24 then signals the valve 46 to allow water from the water supply 44 into port 97 wherein the water may be directed by the water diverter 99 through the second flow path 108 downwards towards the treating chemistry located in the lower dispenser housing 72. Essentially, the automatic clothes washing machine 10 effects a flushing of both the lower dispenser housing 72 and the conduit formed by the lower dispenser housing 72 and the dispensing line 38. The flushing of the lower dispenser housing 72 or conduit may also act to flush the dispenser pump 84, which fluidly couples the conduit. The controller 24 may also introduce water from the water supply 44 into the dispenser drawer 76 by way of the fourth water flow path 102, or any other suitable water path. This may act to flush both the dispenser drawer 76 and at least a portion of the lower dispenser housing 72 as they may be fluidly coupled. Then, both the water and the treating chemistry travel down the lower dispenser housing 72, through the outlet port 98, through the dispensing line 38, and into the treating chamber, the drum 16. After exiting the lower dispenser housing 72 through the outlet port 98 the treating chemistry may also go through any accompanying sprayers or conduits on its way to the drum 16.

The water diverter 99 and upper dispenser housing 74 with its five flow paths provide for a simplified water system that reduces the redundancy in the water supply system. It also provides a simple mechanism by which the controller 24 can effect the dispensing from either the single use dispensing system or the bulk dispensing system. The controller 24 need only select the flow path to the desired portion of the system to effect dispensing. The five flow paths also work hand-in-hand with the bulk dispensing cartridge to provide a dispensing system that has an integrated single use dispensing system and a bulk dispensing, which are independently supplied water.

While the invention has been specifically described in connection with certain specific embodiments thereof, it is to be understood that this is by way of illustration and not of limitation, and the scope of the appended claims should be construed as broadly as the prior art will permit.

What is claimed is:

1. A household cleaning appliance configured to execute a cleaning cycle on an article, comprising:

a cabinet defining an interior;

a treating chamber located within the interior for receiving the article for cleaning;

a drawer slideably mounted to the cabinet for movement between a closed position at least in part interior of the cabinet and an opened position at least in part exterior of the cabinet;

a single use dispensing system comprising a dispensing cup coupled with the drawer and fluidly coupled to the treating chamber;

a bulk dispensing system having a bulk dispensing cartridge configured to store multiple charges of treating chemistry and coupled with the drawer and fluidly coupled to the treating chamber;

a housing fluidly coupling the single use dispensing system and the bulk dispensing cartridge to the treating chamber when the drawer is in the closed position;

a water supply line configured to supply water from a household water supply;

a single use dispensing flow path configured to supply water to the treating chamber through the dispensing cup to direct treating chemistry from the dispensing cup to the treating chamber;

a bulk dispensing flow path configured to supply water to the treating chamber through the housing while bypassing the drawer to direct a charge of treating chemistry dispensed from the bulk dispensing cartridge into the treating chamber;

a controller operably coupled to the water supply line and the bulk dispensing system, and configured to:

direct water from the water supply line down the single use dispensing flow path for manual dispensing; and dispense a charge of treating chemistry from the bulk dispensing cartridge and direct water from the water supply line down the bulk dispensing flow path for bulk dispensing.

2. The household cleaning appliance of claim 1 wherein the bulk dispensing cartridge is fluidly coupled to the housing to dispense the charge of treating chemistry to the treating chamber through the housing while bypassing the drawer.

3. The household cleaning appliance of claim 1 wherein the single use and bulk dispensing water flow paths direct the treating chemistry from the dispensing cup and the charge of treating chemistry from the bulk dispensing cartridge to the treating chamber by flushing.

4. The household cleaning appliance of claim 1, further comprising a dispensing line fluidly coupling the housing to the treating chamber such that water flushed from the single use dispensing system and the bulk dispensing system is directed to the treating chamber by the dispensing line.

5. The household cleaning appliance of claim 1 wherein the single use and bulk dispensing water flow paths are independent from each other prior to reaching the housing.

6. The household cleaning appliance of claim 1 wherein the single use dispensing flow path comprises a path configured to supply water to the housing through the dispensing cup.

7. The household cleaning appliance of claim 1 wherein the bulk dispensing cartridge is configured to be carried by the drawer.

8. The household cleaning appliance of claim 1, wherein the controller is operably coupled to the bulk dispensing system and configured to determine whether to operate the appliance in a manual-dispensing mode or a bulk dispensing mode.

9. The household cleaning appliance of claim 8 wherein the controller is configured to receive input regarding a presence of the bulk dispensing cartridge and determine whether to operate in the manual-dispensing mode or bulk dispensing mode.

10. The household cleaning appliance of claim 1, further comprising a water diverter configured to selectively fluidly couple the water supply line to one of the single use dispensing flow path or the bulk dispensing flow path.

* * * * *